US006640552B1

(12) United States Patent
Rampersad et al.

(10) Patent No.: US 6,640,552 B1
(45) Date of Patent: Nov. 4, 2003

(54) CRYOGENIC SUPERCONDUCTOR COOLING SYSTEM

(75) Inventors: Bryce Mark Rampersad, Williamsville, NY (US); Dante Patrick Bonaquist, Grand Island, NY (US); Barry Alan Minbiole, East Amherst, NY (US); Arun Acharya, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/254,805

(22) Filed: Sep. 26, 2002

(51) Int. Cl.[7] ..... F25B 9/00
(52) U.S. Cl. ..... 62/6
(58) Field of Search ..... 62/6, 51.1, 467, 62/513, 259.2

(56) References Cited

U.S. PATENT DOCUMENTS 4,884,409 A 12/1989 Quack et al. ..... 62/51.1
5,513,498 A 5/1996 Ackermann et al. ..... 62/51.1
5,848,532 A 12/1998 Gamble et al. ..... 62/48.2
6,205,812 B1 3/2001 Acharya et al. ..... 62/607
6,347,522 B1 2/2002 Maguire et al. ..... 62/6
6,376,943 B1 4/2002 Gamble et al. ..... 310/52
6,415,613 B1 7/2002 Ackermann et al. ..... 62/51.1
6,415,628 B1 7/2002 Ahmed et al. ..... 62/534
6,425,250 B1 7/2002 Acharya et al. ..... 62/6
6,438,969 B1 8/2002 Laskaris et al. ..... 62/51.1
6,442,949 B1 * 9/2002 Laskaris et al. ..... 62/51.1

* cited by examiner

*Primary Examiner*—Henry Bennett
*Assistant Examiner*—Malik N. Drake
(74) *Attorney, Agent, or Firm*—Stanley Ktorides

(57) ABSTRACT

A system for providing refrigeration to a superconducting device wherein a cooling fluid is cooled by receiving refrigeration from one or more cryocoolers and then is warmed by indirect heat exchange with ballast liquid thereby providing cooling to the ballast liquid prior to providing refrigeration to the superconducting device.

20 Claims, 3 Drawing Sheets

CRYOGENIC SUPERCONDUCTOR COOLING SYSTEM

TECHNICAL FIELD

This invention relates generally to refrigeration and, more particularly, to refrigeration for superconductivity applications.

BACKGROUND ART

Superconductivity is the phenomenon wherein certain metals, alloys and compounds lose electrical resistance so that they have infinite electrical conductivity. Until recently, superconductivity was observed only at extremely low temperatures just slightly above absolute zero. Maintaining superconductors at such low temperatures is very expensive, typically requiring the use of liquid helium, thus limiting the commercial applications for this technology.

Recently a number of materials have been discovered which exhibit superconductivity at higher temperatures, such as in the range from 15 to 75 K. Liquid nitrogen, a relatively low cost way to provide cryogenic refrigeration, cannot effectively provide refrigeration to get down to the superconducting temperatures of most high temperature superconductors.

An electric transmission cable made of high temperature superconducting materials offers significant benefits for the transmission of large amounts of electricity with very little loss. High temperature superconducting material performance generally improves roughly an order of magnitude at temperatures of about 30 to 40 K from that at temperatures around 80 K which is achieved using liquid nitrogen.

The application of superconducting equipment such as motors, transformers, generators, magnets and others is dependent in part on the development of reliable refrigeration systems. Superconducting systems need to be maintained at temperatures in the range of 4 to 80 K and to be shielded from heat leak starting at ambient temperature down to the operating temperature of the superconducting system.

Accordingly, it is an object of this invention to provide an effective and reliable system for providing refrigeration to superconducting equipment.

SUMMARY OF THE INVENTION

The above and other objects, which will become apparent to those skilled in the art upon a reading of this disclosure are attained by the present invention, one aspect of which is:

A method for providing refrigeration to superconducting equipment comprising:

(A) providing refrigeration from a cryocooler to a cooling fluid to produce cooled cooling fluid;

(B) warming the cooled cooling fluid by indirect heat exchange with ballast liquid; and thereafter (C) passing the cooling fluid to superconducting equipment and providing refrigeration to the superconducting equipment.

Another aspect of the invention is:

Apparatus for providing refrigeration to superconducting equipment comprising:

(A) a cryocooler and means for passing cooling fluid to the cryocooler;

(B) a ballast tank containing ballast liquid, and means for passing cooling fluid from the cryocooler in indirect heat exchange with the ballast liquid within the ballast tank; and (C) superconducting equipment, and means for passing cooling fluid from the ballast tank to the superconducting equipment.

As used herein the term "cryogenic temperature" means a temperature at or below 120 K.

As used herein the term "crycooler" means a refrigerating machine able to achieve and maintain cryogenic temperatures As used herein the term "superconductor" means a material that loses all of its resistance to the conduction of an electrical current once the material attains some cryogenic temperature.

As used herein the term "refrigeration" means the capability to reject heat from a subambient temperature entity.

As used herein the term "indirect heat exchange" means the bringing of fluids into heat exchange relation without any physical contact or intermixing of the fluids with each other.

As used herein the term "direct heat exchange" means the transfer of refrigeration through contact of cooling and heating entities.

As used herein the term "superconducting equipment" means equipment that utilizes superconductor material, for example, in the form of wire for the coils of a rotor for a generator or motor, or for the coils of a magnet or transformer.

DETAILED DESCRIPTION

Figure 1:
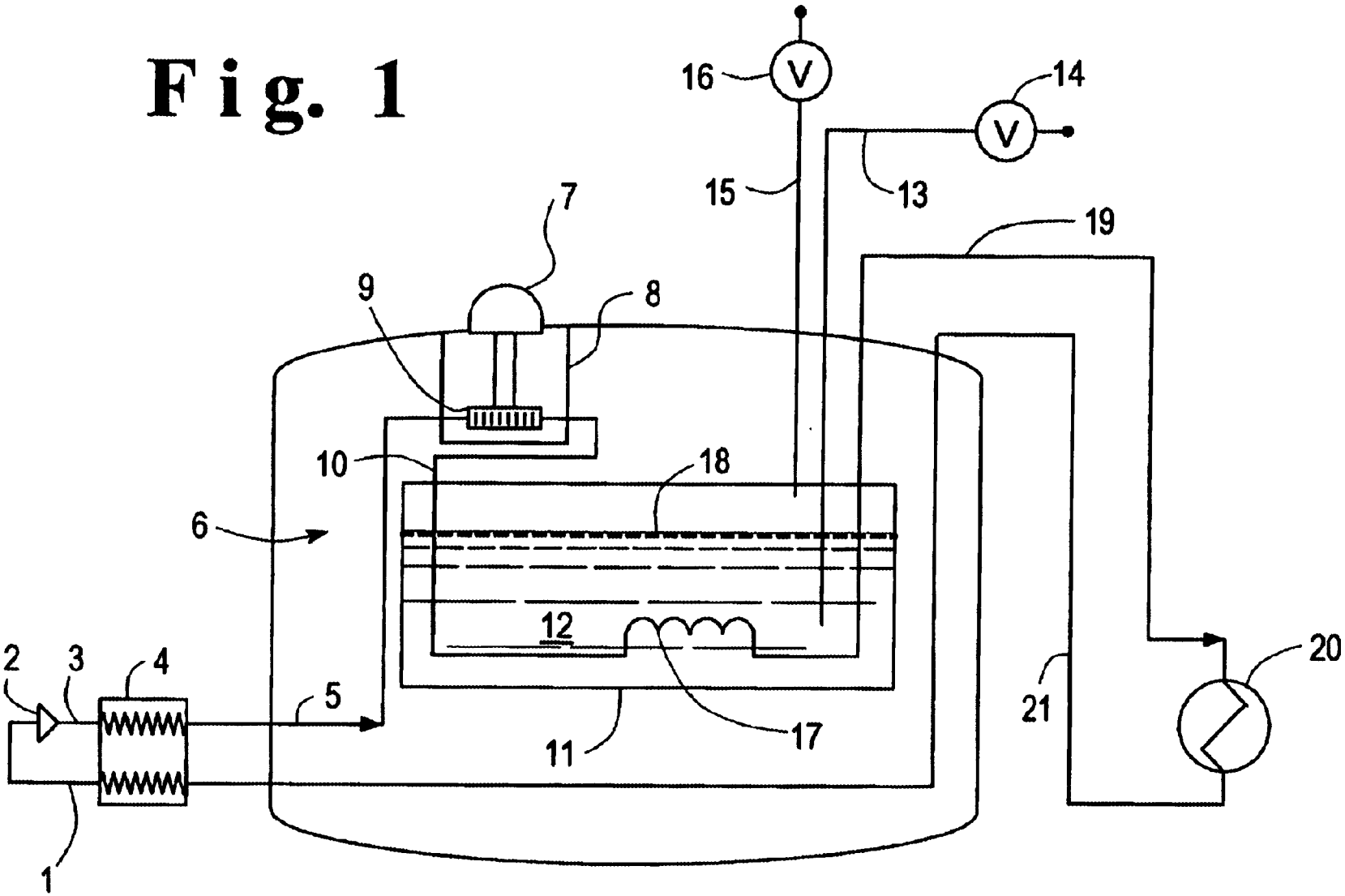
FIG. 1 is a schematic representation of one preferred embodiment of the cryogenic superconductor cooling system of the invention.

The invention will be described in detail with reference to the Drawings. Referring now to FIG. 1, cooling fluid 1 is made to circulate at a pressure generally within the range of from 20 to 30 pounds per square inch absolute (psia) by passage through compressor or pump 2 and the resulting cooling fluid 3 is cooled in recuperative heat exchanger 4 by indirect heat exchange with recirculating cooling fluid as will be more fully described below. Cooling fluid 5 then passes from heat exchanger 4 into enclosure 6 which is preferably under a vacuum, e.g. at a pressure generally within the range of from $10^{-3}$ to $10^{-5}$ torr. The vacuum space provides insulation from convective and conductive heat transfer to equipment and fluids a cryogenic temperatures. Typically the vacuum insulation is combined with radiation shields to minimize the heat leak from ambient to the cryogenic equipment and fluids contained in the system. Although shown in the Drawings for purposes of elucidation as being outside the evacuated enclosure, in practice the recuperative heat exchanger is preferably contained within the evacuated enclosure or, since it is operating at cryogenic temperatures, is insulated in its own vacuum space.

The cooling fluid used in the practice of this invention may be in gaseous, liquid, or mixed phase, i.e. gaseous and liquid, form. The preferred cooling fluid used in the practice of this invention is helium. Other fluids which may be used as the cooling fluid in the practice of this invention include neon, and mixtures containing one or more of helium and neon.

Cooling fluid 5, which is typically at a temperature within the range of from 30 to 50 K, is passed to cryocooler 7 which is within vacuum sleeve 8. The vacuum sleeve provides insulation to the cold tip of the cryocooler and the cold tip heat exchanger. The vacuum spaces insulating the ballast liquid and the cryocooler are preferably kept separate to allow for maintenance and removal of the cryocooler without compromising the insulation of the ballast liquid.

In the embodiment of the invention illustrated in FIG. 1, the cryocooler is a Gifford-McMahon refrigerator system. Other cryocoolers which may be used in the practice of this invention include pulse tube refrigerators. Those skilled in the art are familiar with these cryocoolers and with their operation.

Referring back now to FIG. 1, cooling fluid 5 is passed through cold end heat exchanger 9 of cryocooler 7 wherein refrigeration is provided into the cooling fluid which emerges from cryocooler 7 in a refrigerated condition as cooled cooling fluid 10, generally at a temperature within the range of from 20 to 30 K.

Within evacuated enclosure 6 there is positioned ballast tank 11 which contains ballast liquid 12. The preferred ballast liquid in the practice of this invention is neon. Other fluids which may be used as the ballast liquid in the practice of this invention include hydrogen, nitrogen, and mixtures containing one or more of neon, hydrogen and nitrogen. The ballast liquid is provided into ballast tank 11 through fill line 13 and valve 14, and vaporized ballast is passed out from ballast tank 11 through vent line 15 and valve 16.

The ballast liquid 12 is at a temperature which is greater than the temperature of cooled cooling fluid 10. Typically the temperature of liquid ballast 12 is within the range of from 25 to 35 K and exceeds the temperature of cooled cooling fluid 10 by from 2 to 5 degrees K. The cooled cooling fluid 10 is passed in indirect heat exchange with ballast liquid 12. The cooled cooling fluid is warmed by indirect heat exchange with the ballast liquid thereby providing refrigeration to the ballast liquid. In the embodiment of the invention illustrated in FIG. 1, this indirect heat exchange between the cooled cooling fluid and the ballast liquid takes place by passage of the cooled cooling fluid through ballast heat exchanger 17 which is positioned within ballast tank 11 and below the liquid level or top surface 18 of ballast liquid 12.

The cooling fluid emerges after the indirect heat exchange with the ballast liquid as cooling fluid 19 which has a temperature which exceeds the temperature of cooled cooling fluid 10, typically by from 1 to 4 degrees K. After the indirect heat exchange with the ballast liquid the cooling fluid is passed to superconducting equipment 20 wherein it provides refrigeration to the superconducting equipment 20 either by direct or indirect heat exchange. Examples of superconducting equipment which may be used in the practice of this invention include generators, motors, magnets and transformers.

The cooling fluid 21 after the heat exchange with superconducting equipment 20 is typically at a temperature within the range of from 25 to 30 K and is recycled to heat exchanger 4. The cooling fluid is further warmed by passage through heat exchanger 4 by indirect heat exchange with cooling fluid 3 as was previously described, and emerges from heat exchanger 4 as cooling fluid stream 1 and the recirculating cooling fluid cycle begins anew.

The warming of the cooled cooling fluid by indirect heat exchange with the ballast liquid in the ballast tank thereby providing cooling to the ballast liquid is a very important aspect of this invention. By this heat exchange step, which is opposite to that of any conventional practice, the ballast liquid is maintained at a sufficiently low temperature and in a liquid state so that, in the event that the cryocooler fails or the cryocooler cooling capacity is reduced, the liquid ballast can take over the cooling function so as to enable effective delivery of cooled cooling fluid to the superconducting equipment to maintain low temperature superconducting conditions until the cryocooler is repaired or replaced or the cryocooling function is otherwise restored. This significantly increases the reliability and thus the value of the cooling system for the superconductor. The invention takes advantage of the relatively large temperature difference at the cold tip of the cryocooler for higher heat transfer capacity and the significantly increased cooling capacity of the cryocooler due to the cold tip operating at the highest cryogenic temperature on the system.

The embodiment of the invention illustrated in FIG. 1 is one preferred embodiment of the invention. Other embodiments of the invention may also be practiced. For example, a plurality of cryocoolers, in parallel or in series, may be used to cool the cooling fluid prior to passing the cooled cooling fluid in indirect heat exchange with the liquid ballast. In another embodiment, the cooling fluid after the indirect heat exchange with the liquid ballast, is cooled by a second passage through the cryocooler prior to being passed to the superconductor.

Figure 2:
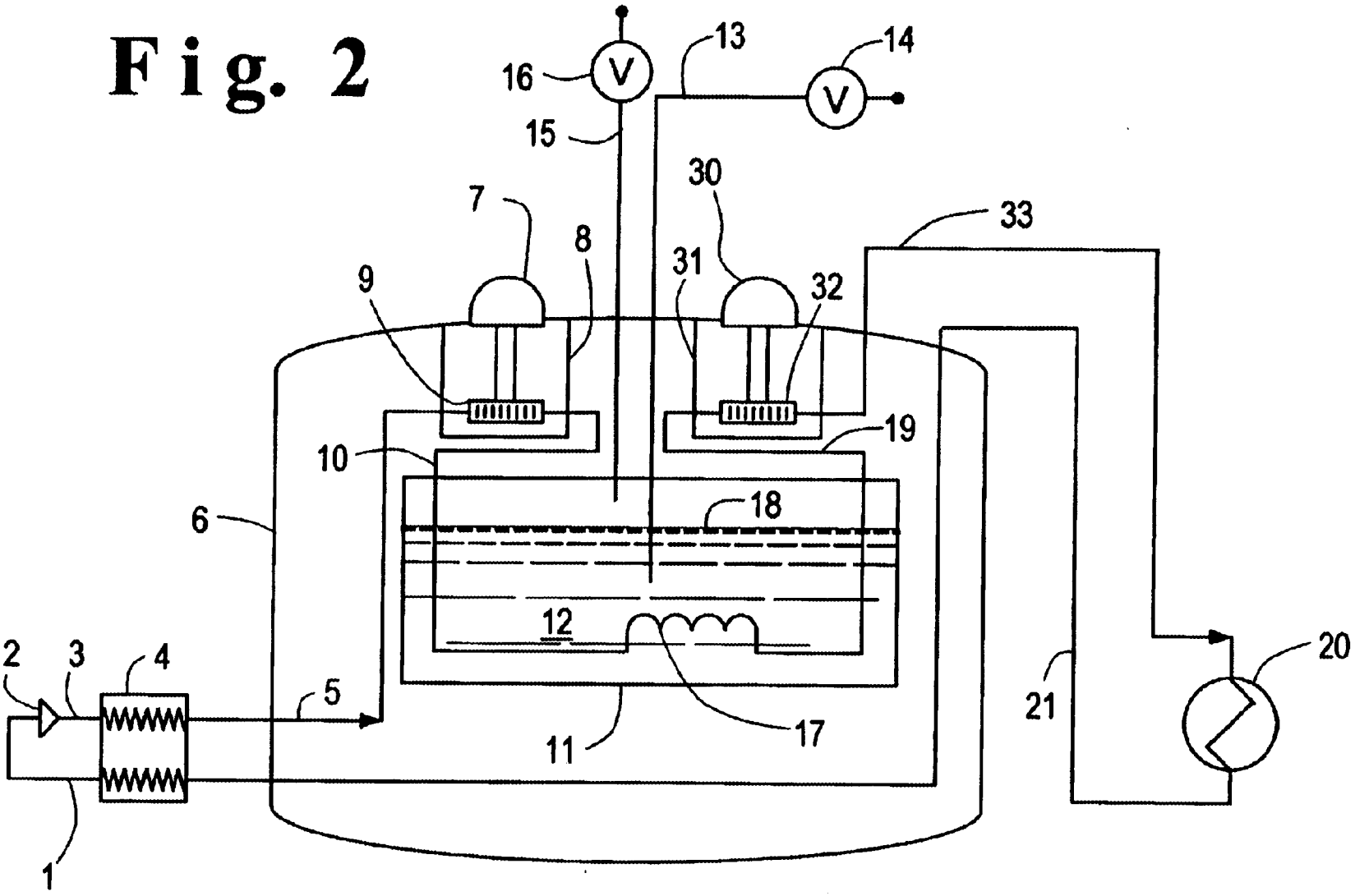
FIG. 2 is a schematic representation of another preferred embodiment of the cryogenic superconductor cooling system of the invention.

FIG. 2 illustrates yet another preferred embodiment of the invention. The numerals in FIG. 2 are the same as those of FIG. 1 for the common elements, and these common elements will not be discussed again in detail.

Referring now to FIG. 2, cooling fluid 19, after the indirect heat exchange with the ballast liquid, is passed to second cryocooler 30, which in the embodiment illustrated in FIG. 2 is a Gifford-McMahon refrigerator. Cryocooler 30 is positioned in vacuum sleeve 31 within evacuated enclosure 6. Cooling fluid 19 is cooled by passage through cold heat exchanger 32 of second cryocooler 30, emerging therefrom as cooling fluid 33, having a temperature which is less than the temperature of cooling fluid 19, generally by from 1 to 10 degrees K, and generally within the range of from 20 to 25 K. Low temperature cooling fluid 33 is passed to superconducting equipment 20 to provide refrigeration to the superconducting equipment as was previously described.

Figure 3:
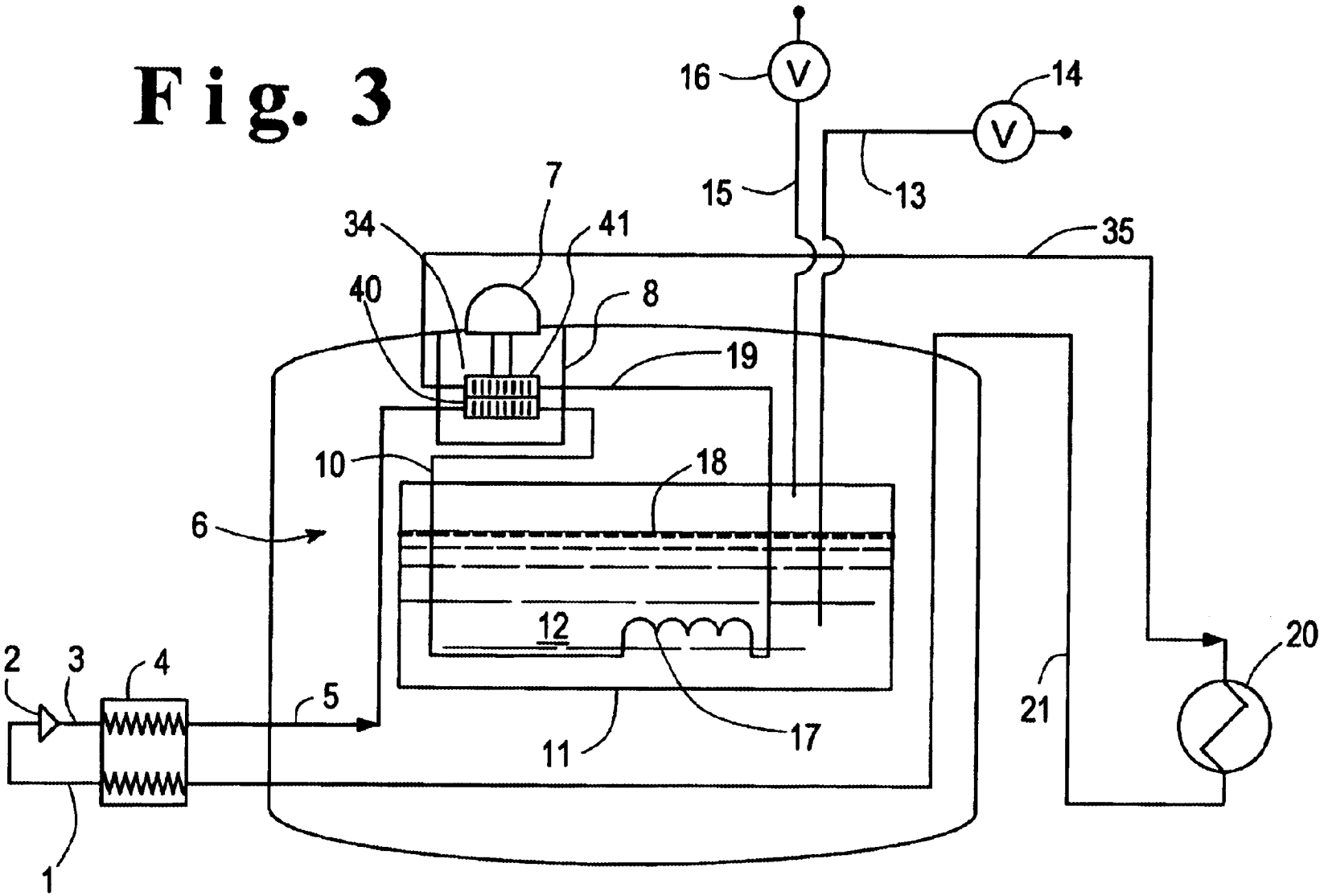
FIG. 3 is a schematic representation of yet another preferred embodiment of the cryogenic superconductor cooling system of the invention.

FIG. 3 illustrates another preferred embodiment of the invention wherein the cryocooler has a multiple pass heat exchanger at the cryocooler cold tip. The numerals in FIG. 3 are the same as those of FIGS. 1 and 2 for the common elements, and these common elements will not be discussed again in detail.

Referring now to FIG. 3, cooling fluid 19, after the indirect heat exchange with the ballast liquid, is passed back to cryocooler 7 which comprises cold end heat exchanger 34 having passes 40 and 41. Cooling fluid 19 is cooled by passage through pass 41 of heat exchanger 34, emerging therefrom as cooling fluid 35. In this embodiment cooling fluid 5 passes through pass 40 of multiple pass heat exchanger 34 to be cooled to form cooled cooling fluid 10. Cooling fluid 35 has a temperature which is less than the temperature of cooling fluid 19, generally by from 1 to 5 degrees K, and generally is within the range of from 25 to 30 K. Low temperature cooling fluid 35 is passed to superconducting equipment 20 to provide refrigeration to the superconducting equipment as was previously described.

Although the invention has been described in detail with reference to certain preferred embodiments, those skilled in the art will recognize that there are other embodiments of the invention within the spirit and the scope of the claims.

What is claimed is:

1. A method for providing refrigeration to superconducting equipment comprising:

(A) providing refrigeration from a cryocooler to a cooling fluid to produce cooled cooling fluid;

(B) warming the cooled cooling fluid by indirect heat exchange with ballast liquid; and thereafter (C) passing the cooling fluid to superconducting equipment and providing refrigeration to the superconducting equipment.

2. The method of claim 1 wherein the cooling fluid comprises helium.

3. The method of claim 1 wherein the ballast liquid comprises neon.

4. The method of claim 1 further comprising cooling the cooling fluid after the indirect heat exchange with the ballast liquid and prior to passing the cooling fluid to the superconducting equipment.

5. A method for providing refrigeration to superconducting equipment comprising:

(A) providing refrigeration from a cryocooler to a cooling fluid to produce cooled cooling fluid;

(B) warming the cooled cooling fluid by indirect heat exchange with ballast liquid by passing the cooling fluid through a heat exchanger which is within a ballast tank which houses the ballast liquid; and thereafter (C) passing the cooling fluid to superconducting equipment and providing refrigeration to the superconducting equipment.

6. The apparatus of claim 5 wherein the cryocooler is a Gifford-McMahon refrigerator.

7. The apparatus of claim 5 wherein the cryocooler is a pulse tube refrigerator.

8. The apparatus of claim 5 wherein the crycooler is positioned within a vacuum sleeve within an evacuated enclosure.

9. The apparatus of claim 5 wherein the cryocooler comprises a multiple pass heat exchanger and the means for passing cooling fluid from the ballast tank to the superconducting equipment includes the cryocooler.

10. The apparatus of claim 5 further comprising a second cryocooler wherein the means for passing cooling fluid from the ballast tank to the superconducting equipment includes the second cryocooler.

11. Apparatus for providing refrigeration to superconducting equipment comprising:

(A) a cryocooler and means for passing cooling fluid to the cryocooler;

(B) a ballast tank containing ballast liquid, said ballast tank being within an evacuated enclosure, and means for passing cooling fluid from the cryocooler in indirect heat exchange with the ballast liquid within the ballast tank; and (C) superconducting equipment, and means for passing cooling fluid from the ballast tank to the superconducting equipment.

12. The method of claim 11 wherein the cooling fluid comprises helium.

13. The method of claim 11 wherein the ballast liquid comprises neon.

14. The method of claim 11 further comprising cooling the cooling fluid after the indirect heat exchange with the ballast liquid and prior to passing the cooling fluid to the superconducting equipment.

15. Apparatus for providing refrigeration to superconducting equipment comprising:

(A) a cryocooler and means for passing cooling fluid to the cryocooler;

(B) a ballast tank containing ballast liquid, and means for passing cooling fluid from the cryocooler in indirect heat exchange with the ballast liquid within the ballast tank; and (C) superconducting equipment, and means for passing cooling fluid from the ballast tank to the superconducting equipment.

16. The apparatus of claim 15 wherein the cryocooler is a Gifford-McMahon refrigerator.

17. The apparatus of claim 15 wherein the cryocooler is a pulse tube refrigerator.

18. The apparatus of claim 15 wherein the cryocooler is positioned within a vacuum sleeve within an evacuated enclosure.

19. The apparatus of claim 15 wherein the cryocooler comprises a multiple pass heat exchanger and the means for passing cooling fluid from the ballast tank to the superconducting equipment includes the cryocooler.

20. The apparatus of claim 15 further comprising a second cryocooler wherein the means for passing cooling fluid from the ballast tank to the superconducting equipment includes the second cryocooler.

* * * * *

UNITED STATES PATENT AND TRADEMARK OFFICE

CERTIFICATE OF CORRECTION

PATENT NO. : 6,640,552 B1
DATED : November 4, 2003
INVENTOR(S) : Rampersad et al.

It is certified that error appears in the above-identified patent and that said Letters Patent is hereby corrected as shown below:

Column 5,
Lines 33, 35, 37, 40 and 44, delete "5" and insert therefor -- 11 --.

Column 6,
Lines 12, 14 and 16, delete "11" and insert therefor -- 5 --.

Signed and Sealed this

Ninth Day of March, 2004

JON W. DUDAS
*Acting Director of the United States Patent and Trademark Office*